United States Patent [19]

Barkalow

[11] 4,361,140

[45] Nov. 30, 1982

[54] CARDIOPULMONARY RESUSCITATOR MASSAGER PAD

[75] Inventor: Clare E. Barkalow, Comstock Park, Mich.

[73] Assignee: Michigan Instruments, Inc., Grand Rapids, Mich.

[21] Appl. No.: 126,878

[22] Filed: Mar. 3, 1980

[51] Int. Cl.[3] ..... A61H 31/00

[52] U.S. Cl. ..... 128/53

[58] Field of Search ..... 15/110, 198, 215; 128/24 R, 24.3, 28, 33, 44, 51-57, 60, 62 R, 64, 67-69, 80 R, 80 D, 581, 582, 205.25, 38, 39; 92/42; 5/441, 449; 297/DIG. 3

[56] References Cited

U.S. PATENT DOCUMENTS

| | | | |
|---|---|---|---|
| 2,078,536 | 4/1937 | Hardman | 128/38 |
| 2,945,693 | 7/1960 | Way | 273/65 EB |
| 3,374,783 | 3/1968 | Hurvitz | 128/51 |
| 3,401,607 | 9/1968 | Wortmann | 92/42 |
| 3,461,860 | 8/1969 | Barkalow | 128/53 |
| 3,689,948 | 9/1972 | Graves | 5/449 |
| 3,970,076 | 7/1976 | Hepp | 128/64 |
| 4,059,099 | 11/1977 | Davis | 128/28 |

FOREIGN PATENT DOCUMENTS

| | | | |
|---|---|---|---|
| 2357417 | 7/1976 | France | 297/DIG. 3 |

*Primary Examiner*—Richard J. Apley
*Assistant Examiner*—Carl Moy
*Attorney, Agent, or Firm*—Price, Heneveld, Huizenga & Cooper

[57] ABSTRACT

A cardiopulmonary resuscitator massager pad is provided comprising a compressible, fluid filled enclosure adapted for mounting on the reciprocal piston of a cardiopulmonary resuscitator. The massager pad includes means for restricting lateral expansion of the enclosure and a face including means for evenly distributing the pressure of the fluid in the enclosure on the patient's chest.

11 Claims, 5 Drawing Figures

CARDIOPULMONARY RESUSCITATOR MASSAGER PAD

BACKGROUND OF THE INVENTION

The invention relates generally to mechanical cardiopulmonary resuscitation techniques and more particularly, is directed to an improved massager pad for a cardiopulmonary resuscitator.

External cardiac compression can be effectively employed for obtaining perfusion by causing forced pumping of blood from a temporarily stopped heart. This is achieved by constant cyclic external compression of the heart (systole) for a short time period followed by pressure release to allow heart expansion (diastole) for a short time period. To achieve proper heart compression by external force, the breastbone or sternum is forced toward the backbone of the patient while the patient's back is rigidly supported.

Although forced pumping of blood is essential for a patient whose heart has stopped, this is only part of the continuous treatment necessary since once the heart stops, breathing stops also. Hence, when external mechanical or manual cardiac compression is presently employed, simultaneous sustained cyclic mechanical or mouth-to-mouth ventilation is also important to cyclically inflate the lungs for oxygenization of the blood. According to currently accepted medical practice, the lungs are ventilated or inflated during the diastole period of the compression cycle. Other techniques have employed ventilation simultaneously with external cardiac compression to use the relatively high intrathoracic pressures thus generated to enhance perfusion and the pumping of blood. Whether carried out mechanically or manually, these techniques comprise what is commonly referred to as cardiopulmonary resuscitation or CPR.

Current standards for teaching and practicing manual cardiopulmonary resuscitation specifies that the pressure for external cardiac compression is to be applied to the patient's sternum, using the heel of one hand and that care must be exercised to avoid applying any direct force to the patient's ribs. The rationale for these standards are stated to be that this technique creates more effective cardiac compression with less applied force and less risk of rib fracture.

Since specifications have not been formulated for mechanically applied CPR, it has been logical to use the expressed standards for manual CPR as a guideline for the design of mechanical cardiopulmonary resuscitators. Thus, the massager pad for all such mechanical devices have been designed to simulate the "heel of the hand" in shape, texture, and resilience.

By study of the anatomical structure, it is known that depression of the patient's sternum toward the vertebral column, as required by current CPR techniques, requires deformation of the rib cage in the form of substantially uniform bending of each rib throughout its length, and a hinging type of motion at the costa chondral junctures between the ribs and the patient's sternum. If the compression force is isolated on the sternum, substantial tension and sheer stresses are created in the costa chrondral junctures separation of the costa chondral junctures as a result of external cardiac compression. While such a separation of the costa chrondral junctures is not a fatal or serious trauma, it is nevertheless an undesirable complication of manual or mechanical CPR techniques.

Another trauma commonly observed with current CPR techniques is bruising and abrasion of the external chest produced by the relatively large pressures required to achieve adequate sternal deflection and adequate cardiac output. In large adults, these pressures can be as high as 60 pounds per square inch with either manual or mechanical CPR techniques.

SUMMARY OF THE INVENTION

The present invention is directed to a massager pad for use with mechanical CPR devices which substantially reduces the risk of trauma to the chest wall and costa chondral junctures without detracting from the effectiveness of the applied mechanical CPR. The massage pad comprises a compressible enclosure adapted for mounting on a reciprocal compressor piston for compression between the piston and a patient's chest. The enclosure is filled with a substantially incompressible fluid such as a silicone gel. Means is provided for restricting lateral expansion of the enclosure such that the piston displacement is fully transmitted to the chest of the patient and the observed piston displacement is basically equivalent to the patient's chest deflection. The compressor pad is provided with a face for engaging the patient's chest and the face includes means for evenly distributing the pressure of the fluid on the patient's chest. In general, the area of the face of the compressor pad is somewhat larger than the area of the "heel of the hand". The somewhat larger compressor pad provides some direct compressive pressure over the rib cage next to the costa chondral junctures, and as long as the pressure is relatively gentle and uniformly distributed, it reinforces and acts to reduce the stress on the costa chondral junctures, without preventing the normal "hinging" motion between the ribs and sternum. The compressible fluid filled pad is compliant to the patient's chest and this together with the use of a larger area than the "heel of the hand" previously specified applies less force per unit area on the patient's chest without significantly reducing total chest deflection. This results in less chest wall, spine, and costa chondral juncture trauma while still providing adequate chest deflection.

DESCRIPTION OF THE PREFERRED EMBODIMENTS

Figure 1:
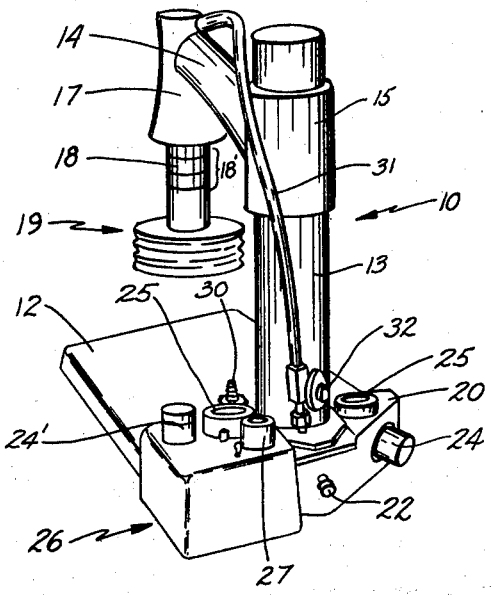
FIG. 1 is a perspective view of a mechanical cardiopulmonary resuscitator suitable for use with the massager pad of the present invention.

Referring to FIG. 1, a combination cardiac compressor and ventilator or cardiopulmonary resuscitator unit is illustrated at 10. The CPR unit 10 includes a platform 12 for supporting the back of the patient; a removable upstanding column or support 13; and an overhanging beam or arm 14 mounted to column 13 with a releasable collar 15. The outer end of the arm 14 includes a pneumatic power cylinder 17 and an extendable plunger or piston 18 with a compressor pad 19 for contacting and compressing a patient's sternum disposed thereon. The piston 18 and compressor pad 19 are pneumatically operable to shift toward the platform 12 to compress the sternum and thus the heart and lungs of the patient resting in the supine position on the platform 12. The piston and pad return with the normal expansion of the patient's chest. The platform 12 includes a thick hollow end 20 in which the support 13 is removably mounted and which includes an internal chamber that encloses a control valve assembly at 22. The control valve assembly repetitively applies pressure to the power cylinder to create a cyclical compression cycle. Protruding from the platform 20 is a pressure regulator knob 24 for controlling pressure of the output of control valve assembly 22. A pressure indicating gauge is disposed at 25. A ventilator subassembly is disposed at 26 and is integrally mounted with the compressor with the exception of a breathing hose normally connected to air outlet 27 and to a mask, endotrachial tube or the like for directing oxygen enriched air into the patient's lungs. A pressure regulator knob 24' and a gauge 25' are used to control the air pressure applied to the patient's lungs during ventilation. A CPR unit suitable for use with the present invention is essentially like that shown in U.S. Pat. No. 3,461,860 to Clare E. Barkalow and the disclosure of this patent is hereby incorporated by reference.

Figure 2:
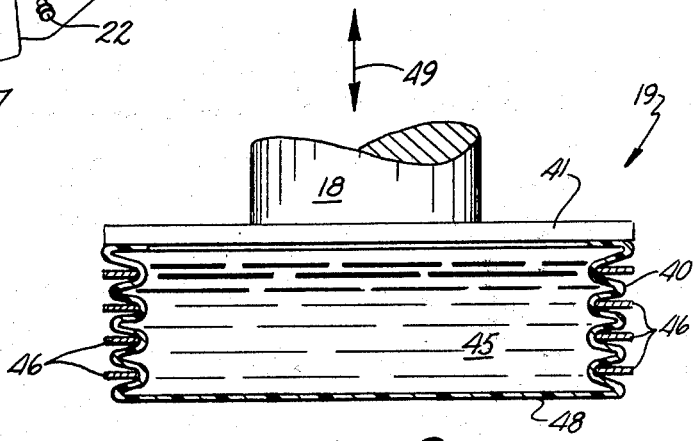
FIG. 2 is a partial sectional view of one embodiment of the massager pad of the present invention.

The massager pad 19 may be rigidly secured to the piston 18 or may be pivotally connected thereto to compensate for patients having a tilted sternum. The massager pad 19 is provided with an oval or circular shape. With reference now to FIG. 2, one embodiment of a massager pad constructed according to the present invention is illustrated in further detail. The massager pad 19 comprises a compressible enclosure 40 adapted for mounting on the compressor piston 18. In this case, the compressible enclosure 40 comprises a bellows made from an elastomer material or the like mounted on rigid backing plate 41 which is suitably secured to the piston 18. The enclosure 40 is filled with a substantially incompressible fluid 45. Many fluids are suitable for use within the enclosure 40, however, in preferred embodiments, the enclosure 40 is filled with a silicone gel. The bellows 40 include means for restricting lateral expansion of the enclosure comprising in this case, a plurality of tension bands or circumferential bands 46 surrounding the bellows 40. Thus, the enclosure 40 can be described as a nonisoelastic structure. An isoelastic structure has elastic properties that are isotropic or uniform in all directions. A nonisoelastic structure is not deformable, or elastic, in all directions. In this case, the nonisoelastic structure is deformable in directions parallel to the path of travel of the reciprocating compressor piston 18 (arrow 49), but is rigid in directions transverse or orthogonal thereto. This facilitates distribution of the compressive force of the piston over a relatively large area on the patient's chest while roughly maintaining a direct correspondence between displacement of the piston and deflection of the patient's chest. The pad further includes a face 48 extending generally orthogonal to the direction of travel of the reciprocating compressor piston 18 (indicated by the arror 49); the face 48 including means for evenly distributing the pressure of the fluid 45 to the patient's chest. In this case, the means for evenly distributing the pressure of the fluid 45 comprises a generally planar face 48 formed from a suitable flexible or compliant elastomeric material. The area of the face 48 is preferably large enough to cover the patient's sternum and extend over the patient's costa chondral junctions. Such an area is substantially larger than the normal "heel of the hand" area of approximately two square inches and may in some cases be as large as ten square inches.

The flexible compressible enclosure sealed and filled with an incompressible fluid serves to evenly distribute the force supplied by the piston 18 over the face 48 of the pad and thus the surface of the patient's chest. Moreover, its compliancy permits conformation of the pad face with the patient's chest contour. This, together with the larger face area significantly reduces the pressure felt by the patient's chest and eliminates any stress concentrations on the sternum or the surrounding portions of the patient's chest. This of course results in less trauma to the surface of the chest. Furthermore, the compliant face 48 of the compressor pad 19 now extends over and reinforces the costa chondral junctures. As long as the pad is compliant and the pressure on the junctures is gentle and uniformly distributed, the junctures although reinforced remain pivotable. Reinforcing the costa chondral junctions with the compressor pad in this manner prevents relatively painful separation of the ribs and sternum at the junctions.

The circumferential bands 46 prevent the pad 19 from laterally expanding to insure that the vertical displacement of the piston 18 is fully transmitted to the chest of the patient. Thus, the observed piston displacement 18 is still roughly equivalent to the patient's chest deflection. This is important since CPR standards require chest deflection to be a predetermined percentage of the total width or depth of the patient's chest and the amount of chest deflection is determined once the CPR is begun by measuring the deflection of the piston 18 with respect to the cylinder 17 of the CPR unit 10. In this regard indicia 18' (illustrated in FIG. 1) is provided on the piston 18 to facilitate measurement of piston deflection during CPR. If the massager pad 19 were not so restricted, bulging or squeezing out of the massager pad would result from compression of the massager pad between the piston 18 and the surface of the patient's chest providing less chest deflection than the indicated piston motion. However, it is important to provide means for restricting lateral expansion of the pad with relatively little vertical stiffness to prevent an increase in pressure on the patient's chest around the circumference of the face 48 of the compressor pad 19.

According to a current CPR theory, at least in some patients, the mechanism for expelling blood from the thorax during external CPR is not wholly related to mechanical cardiac compression, but is augmented as a result of relatively high and properly phased intrathoracic pressures during external chest compression. It has been established that such high intrathoracic pressures working on the vasculature within the thorax in combination with existing valving mechanisms serves to propel blood through the heart in an antegrade direction. Such perfusion coupled with periodic lung ventilation with air or oxygen enriched air provides the patient with cardiopulmonary supportive therapy during heart stoppage. These recent studies have shown that CPR techniques employing high phasic intrathoracic pressures, produced by a combination of high intrapulmonary (ventilation) pressures applied simultaneously with some form of external mechanical chest restriction and/or compression may be the most effective means for providing systemic perfusion. In such cases, an external mechanical chest compressor may be functioning more to enhance the buildup of intrathoracic pressure than to provide direct mechanical compression of the heart per se. Under these conditions, the compressor pad of the present invention serves as a gentle but effective means of preventing chest expansion during simultaneous ventilation or even may produce the desirable effect of still higher levels of intrathoracic pressures when simultaneous chest compression is applied. Thus, the massager pad of the present invention provides significant benefits in patient resuscitation either with current CPR techniques aimed at direct cardiac compression or newer techniques aimed at the development of higher intrathoracic pressures.

Figure 3:
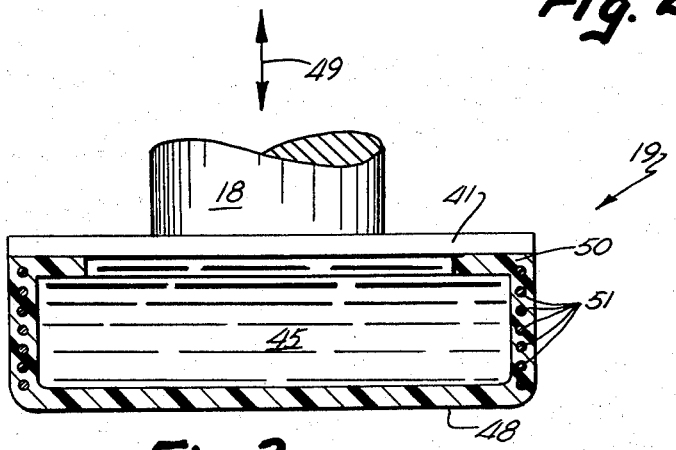
FIG. 3 is a partial sectional view of another embodiment of the massager pad of the present invention.

With reference now to FIG. 3, another embodiment of a compressor pad 19 constructed according to the present invention is illustrated. In the embodiment of FIG. 3, a flexible fluid filled molded elastomer pad 50 is disposed on a relatively stiff backing plate 41 which is suitably connected to the piston 18. The molded elastomer pad 50 includes a plurality of laterally stiffening or reinforcing belts or tension bands 51 encased in the molded elastomer body 50. In this case, the tension bands 51 may be any one of a number of suitable materials, either fibrous or metallic, whereas in the embodiment of FIG. 2, metallic rings 46 are preferred.

Figure 4:
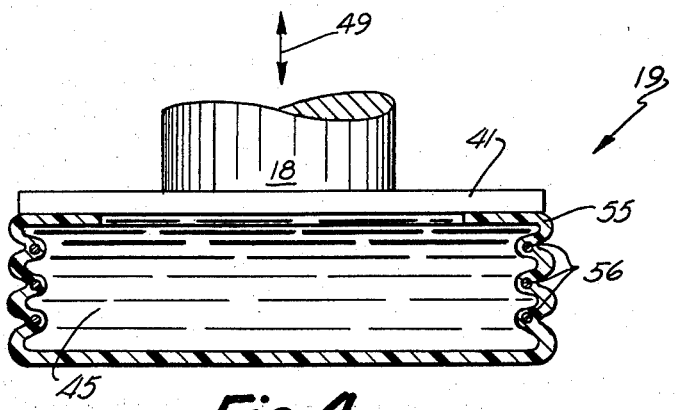
FIG. 4 is a partial sectional view of another embodiment of the massager pad of the present invention.

With reference to FIG. 4 another embodiment of a compressor pad 19 constructed according to the present invention is illustrated. In this case the compressor pad comprises a molded or laminated elastomer pad 55 having corrugated bellows-like sidewalls that provide little vertical stiffness. The pad 55 includes a plurality of laterally stiffening or reinforcing belts or tension bands 56 encased in the elastomer pad 55. The tension bands may be any one of a number of suitable materials, either fibrous or metallic.

Figure 5:
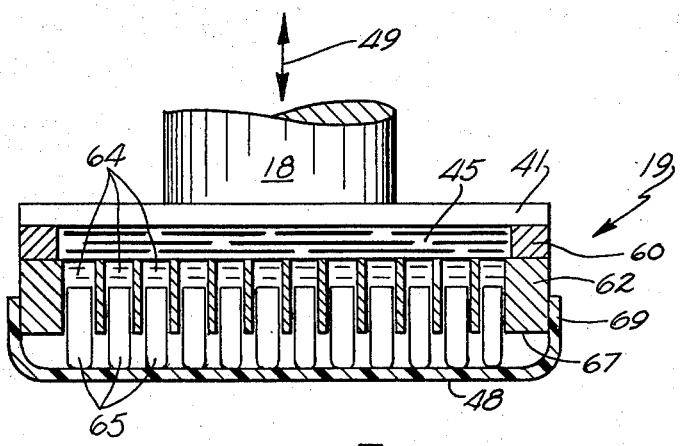
FIG. 5 is a partial sectional view of another embodiment of the massager pad of the present invention.

With reference now to FIG. 5, another embodiment of a compressor pad 19 constructed according to the present invention is illustrated. In this case the compressor pad 19 includes a compressible fluid filled enclosure 60 formed from a structurally rigid body disposed on the backing plate 41, which is suitably secured to the piston 18. The relatively rigid enclosure 60 inherently prevents lateral expansion of the compressible enclosure while defining an interior space filled with the compressible fluid 45. However, the compressor pad illustrated in FIG. 4 also differs from the embodiments previously disclosed in that the means for evenly distributing pressure to the patient's chest comprises a cylinder or plunger plate 62 extending in a direction generally orthogonal to the direction of travel of the reciprocating compressor piston 18. The plunger plate 62 includes an array of cylindrical bores 64 communicating with the interior of the fluid filled enclosure 60. A plurality of generally cylindrical plungers 65 are disposed in the array of bores 60. The plungers 65 extend from the surface 67 of the plunger plate 62 in a direction generally parallel to the direction of travel 49 of the reciprocating piston 18. The enclosure 60, the cylinder or plunger plate 62, and the plungers 65 may be formed from any one of a number of suitable relatively rigid polymeric or metallic materials. The array of closely packed multiple plungers 65 will all take various positions within their respective bores when the pad is compressed on the patient's chest, conforming to irregularities in the patient's chest and evenly distributing the pressure of the fluid 45 to the patient's chest. To further distribute the force applied by the array of plungers 65, and retain the plungers in their respective bores, an elastomer web or the like 69 may be disposed over the plungers 65 for compression between the patient's chest and the plungers.

The above description should be considered as exemplary and that of the preferred embodiment only. The true spirit and scope of the present invention should be determined by reference to the appended claims. It is desired to include within the appended claims all modifications of the invention that come within the proper scope of the invention.

The embodiments of the invention in which an exclusive property or privilege is claimed are defined as follows:

1. A cardiopulmonary resuscitator comprising in combination:

compressor means including a reciprocating piston for periodically applying a compressive force to a patient's chest;

ventilator means for periodically ventilating the patient's lungs; and a compressible fluid filled enclosure disposed on the end of said reciprocating piston for compression between said piston and the patient's chest, said enclosure being filled with a substantially incompressible fluid and said enclosure comprising a nonisoelastic structure that is deformable in directions parallel to the path of travel of said reciprocating compressor piston and that is rigid in directions transverse to the path of travel of said piston, whereby the compressive force of said piston is evenly distributed over a large area on the patient's chest while providing direct correspondence between the displacement of said piston and the deflection of the patient's chest.

2. The cardiopulmonary resuscitator massager pad of claim 1 wherein said enclosure is filled with silicone gel.

3. The cardiopulmonary resuscitator massager pad of claim 1 wherein said enclosure is provided with a substantially planar flexible face for contact with the patient's chest, said face having an area large enough to cover the patient's sternum and extend over the patient's costa chondral junctures.

4. The cardiopulmonary resuscitator massager pad of claim 1 further including means for distributing pressure in said fluid filled enclosure on the patient's chest.

5. The cardiopulmonary resuscitator massager pad of claim 4 wherein said means for distributing pressure comprises a flexible face extending generally orthogonal to the direction of travel of the reciprocating compressor piston for contact with the patient's chest.

6. The cardiopulmonary resuscitator massager pad of claim 4 wherein said means for distributing pressure comprises a plunger plate, said plunger plate extending generally orthogonal to the direction of travel of the reciprocating compressor piston, said plunger plate including an array of bores communicating with the interior of said enclosure and a plurality of plungers disposed in said bores, said plungers extending from the surface of said plunger plate in a direction generally parallel to the direction of travel of the reciprocating compressor piston.

7. The cardiopulmonary resuscitator massager pad of claim 6 further including a flexible web disposed over said plungers for compression between the patient's chest and said plungers.

8. The cardiopulmonary resuscitator massager pad of claim 1 wherein said isoelastic structure comprises means for restricting lateral expansion of said enclosure.

9. The cardiopulmonary resuscitator massager pad of claim 8 wherein said means for restricting lateral expansion of said enclosure comprises a plurality of tension bands surrounding said enclosure.

10. The cardiopulmonary resuscitator massager pad of claim 8 wherein said enclosure comprises a flexible fluid filled bellows and said means for restricting lateral expansion of said enclosure comprises a plurality of circumferential bands surrounding said bellows.

11. The cardiopulmonary resuscitator massager pad of claim 8 wherein said enclosure comprises a molded elastomer body and said means for restricting lateral expansion comprises a plurality of tension bands encased in said molded elastomer body.

* * * * *